US006810838B1

(12) United States Patent
Hellman

(10) Patent No.: US 6,810,838 B1
(45) Date of Patent: Nov. 2, 2004

(54) INDIVIDUAL CYLINDER COOLANT CONTROL SYSTEM AND METHOD

(76) Inventor: Karl Harry Hellman, 2690 Overridge, Ann Arbor, MI (US) 48105

( * ) Notice: Subject to any disclaimer, the term of this patent is extended or adjusted under 35 U.S.C. 154(b) by 0 days.

(21) Appl. No.: 10/459,701

(22) Filed: Jun. 12, 2003

(51) Int. Cl.[7] ..... F01P 7/10
(52) U.S. Cl. ..... 123/41.28; 123/41.29
(58) Field of Search ..... 123/41.28, 42.29

(56) References Cited

U.S. PATENT DOCUMENTS 6,698,388 B2 * 3/2004 Brace et al. ..... 123/41.28
2003/0000487 A1 1/2003 Schmitt

* cited by examiner

*Primary Examiner*—Noah P. Kamen
(74) *Attorney, Agent, or Firm*—Lorusso, Loud & Kelly

(57) ABSTRACT

A coolant system and method for control of cylinder temperature in a multiple cylinder internal combustion engine includes an inlet rail for receiving coolant from a pump, an outlet rail located on a side of the cylinder head opposite the inlet rail and a plurality of individual coolant flow passages extending within the cylinder head and connecting the inlet rail with the outlet rail. A control valve and an associated temperature sensor are provided within each of the coolant flow passages and a controller individually controls each of the control valves in accordance with a signal received from its associated temperature sensor. The control valves may be controlled to bring the temperatures detected by their associated temperature sensors into conformance with an optimum temperature predetermined for engine speed and/or engine torque load.

20 Claims, 4 Drawing Sheets

Figure 4a: Cooling Only the Exhaust Valve
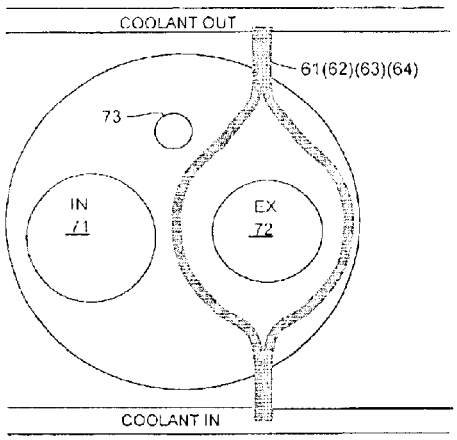
Figure 4b: Cooling the Exhaust Valve and the Spark Plug
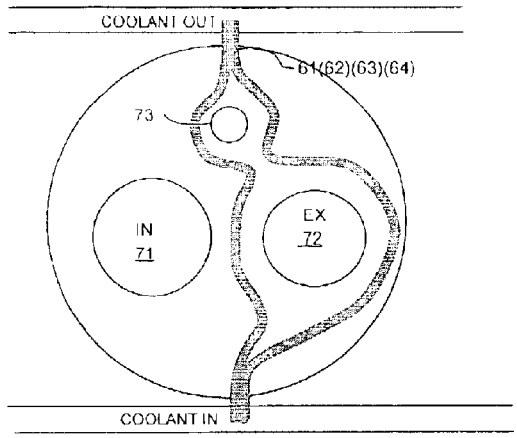
Figure 4c: Cooling the Valve Bridge and the Spark Plug
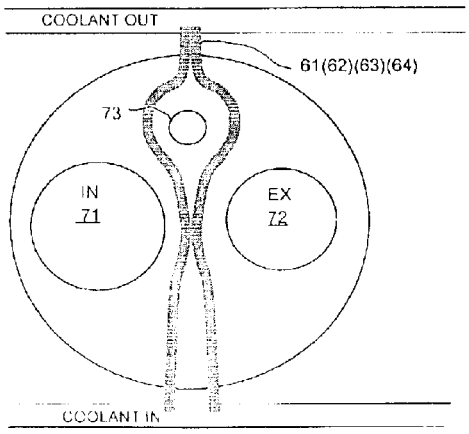
Figure 4d: Cooling the Intake Valve and the Exhaust Valve
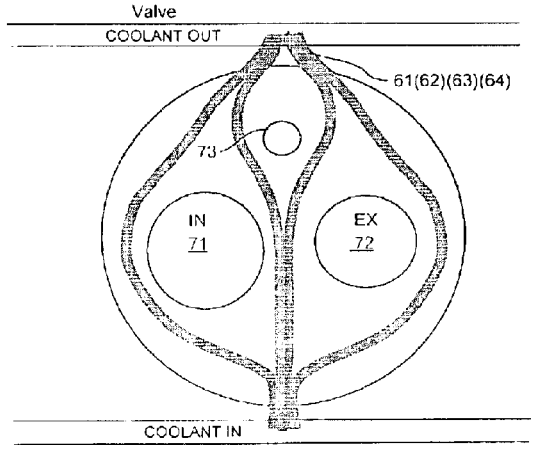
Figure 4e: Cooling the Intake Valve, the Exhaust Valve and the Spark Plug
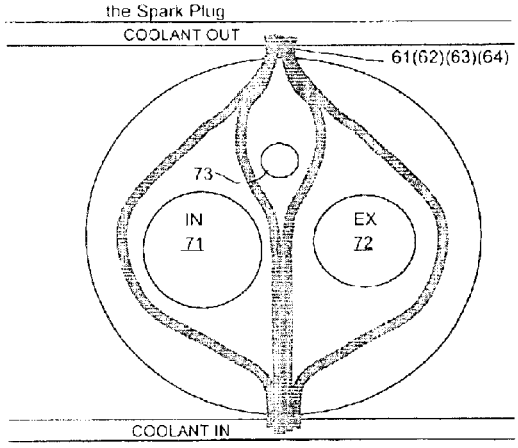

INDIVIDUAL CYLINDER COOLANT CONTROL SYSTEM AND METHOD

BACKGROUND OF THE INVENTION

1. Field of the Invention

The field of the invention is cooling systems of internal combustion engines, specifically those with reciprocating pistons. The invention provides consistent controllable temperatures for each of the cylinders in a multi-cylinder engine.

2. The Prior Art

Conventional systems for cooling cylinder heads provide coolant patterns which go generally from one end of the cylinder head and block to the other. The complicated coolant flow pattern that results is a combination of longitudinal flow and cross flow, but all cylinders are cooled together with a common coolant flow path.

The conventional approach is successful in that engines generally do not overheat. However, the temperatures may vary between cylinders in a way that some cylinders are cooled just barely enough, while other cylinders are overcooled. This difference in cooling can affect the distribution of fuel and air into the cylinders and the initiation of combustion, such that not all of the cylinders attain optimum performance due to cylinder-to-cylinder cooling differences.

Wilkinson—U.S. Pat. No. 5,058,535 teaches the use of a common rail cooling system which directs coolant flow to individual cylinders of flat (180° vee) aircraft engines.

Wells—U.S. Pat. No. 4,601,265 disclose a common rail coolant routing system with an inlet common rail and an outlet common rail on the same side of the cylinder block of an in-line engine. The system of Wells is designed to deliver equal amounts of coolant to each cylinder.

Haugen et al—U.S. Pat. No. 6,279,516 disclose a coolant cross-flow coolant flow system which directs the coolant flow across the cylinder in two levels, essentially over, up, and out, and attempts to minimize any flows between adjacent cylinders.

Abe et al—U.S. Pat. No. 5,386,805 teach a system having a separate inlet and outlet rails for the coolant and also teaches the possibility of using a separate coolant flow pattern in the cylinder block (crossflow) which is different from the coolant flow pattern in the cylinder head.

Kasting et al—U.S. Pat. No. 4,284,037 disclose an engine coolant flow pattern which is substantially separate for each of the cylinders in a multi-cylinder engine. The approach of Kasting et al attempts to provide an equal flow to each cylinder by a static structural design.

Bartolazzi—U.S. Pat. No. 5,975,031 teaches the use of a single temperature sensor in a feedback control system for the fuel pump output and/or the amount of coolant flow bypassed to the radiator.

Takahashi et al—U.S. Pat. No. 5,769,038 teach a design of the coolant flow pattern intended to deliver a uniform amount of coolant delivered to each combustion chamber cooling area, in an attempt to provide equal cooling to the cylinders, without active control of the coolant flow.

Iwamoto et al—U.S. Pat. No. 4,665,867 teach a design of the coolant flow passages on the inlet side of the coolant system that attempts to equalize the coolant flow to each cylinder of a multicylinder engine, without active control of the coolant flow to individual cylinders.

Nakanishi et al—U.S. Pat. No. 4,212,270 disclose the use of two cooling systems, one for the cylinder head and the other for the cylinder block of a multi-cylinder engine.

SUMMARY OF THE INVENTION

The present invention provides open-loop control of individual cylinder cooling with control of the coolant flow to each cylinder provided by multiple sensors (typically, one per cylinder) and individual cylinder coolant flow control valves. This active control of separate and different coolant flows is in contrast to static designs for coolant flow control as exemplified by the Wilkinson, Wells, Kasting, Takahashi and Iwamoto references mentioned above.

The system of the present invention is an individual cylinder coolant control system which includes an inlet common rail, an outlet common rail, a coolant temperature sensor, and a coolant control valve for each cylinder (fewer or more sensors and valves are also possible) and an optional bypass valve to control coolant flow to the inlet common rail. The inlet common rail and/or the outlet common rail can be an integral part of the cylinder head of the engine or be separate from it.

In the individual cylinder coolant control system of the present invention, the coolant flow is separate for each cylinder, each separate flow is actively controlled, the flow direction is across the cylinder head, and the temperature of each cylinder is individually controllable.

Accordingly, the present invention provides a cooling system for an engine including a cylinder block having multiple cylinders covered and closed by a cylinder head. The coolant system includes an inlet rail and an outlet rail located on opposing sides of the cylinder head and a pump for feeding coolant flow through a discharge line into the inlet rail. A return line serves to return coolant from the outlet rail to the other portions of the cooling system and subsequently back to the pump, a plurality of individual coolant flow passages extend within the cylinder head and connect the inlet rail with the outlet rail. A control valve and an associated temperature sensor are provided within each of the coolant flow passages and a controller individually controls each of the control valves in accordance with the signal received from its associated temperature sensor.

The present invention further provides a method for individually controlling the temperature of each of multiple cylinders within a cylinder block and covered by a cylinder head. The method involves passing coolant through separate coolant flow passages, across the cylinder head, between an outlet rail and an inlet rail, sensing the temperature within each of the coolant passages and adjusting and controlling flow through the coolant passage containing the temperature sensor, responsive to a signal from the temperature sensor, to bring the sensed temperature for each of the coolant flow passages into conformance with a predetermined optimum temperature. The method may further include sensing engine load and/or engine speed and determining an optimum temperature, as the predetermined temperature, in accordance with the sensed engine load and/or engine speed. The method may further include directing the flow of coolant from a pump to bypass the inlet and outlet rails and coolant flow passages, during warm-up of the engine, until a sensed temperature reaches a predetermined minimum value. The coolant flow passages may be entirely separate with one coolant flow passage provided for each of the cylinders.

Preferably, a coolant flow passage is uniquely associated with each of the cylinders and the controller, individually for each cylinder, controls a control valve to bring the temperature detected by the associated temperature sensor into conformance with a predetermined optimum temperature. The predetermined optimum temperature may be an optimum temperature for a given load and/or engine speed stored in a memory readable by the controller.

Each of the coolant flow passages may be split so as to pass on both of opposing sides of an exhaust valve, an inlet valve, and/or an ignition device.

The coolant system preferably further includes a bypass rail for connecting the discharge line to the return line, bypassing the inlet and outlet rails and the coolant flow passages, and a splitter valve for selectively directing the discharge of coolant from the pump to the inlet rail and/or to the bypass rail.

Preferably, the coolant system has the inlet and outlet rails formed within the cylinder head.

Accordingly, the present invention provides the following advantages over the prior art:

1. Independent control of the temperature of each cylinder of a multicylinder engine,
2. Rapid warm-up of the passenger compartment,
3. Improved cold-start and warmup efficiency,
4. Lower cold-start and warmup emissions, and
5. Improved warmed up efficiency.

BRIEF DESCRIPTION OF THE DRAWINGS

FIGS. 4*a*–4*e* show different configurations for the flow passage and flow path between inlet and outlet rails for a single cylinder.

DESCRIPTION OF THE PREFERRED EMBODIMENTS

Figure 1:
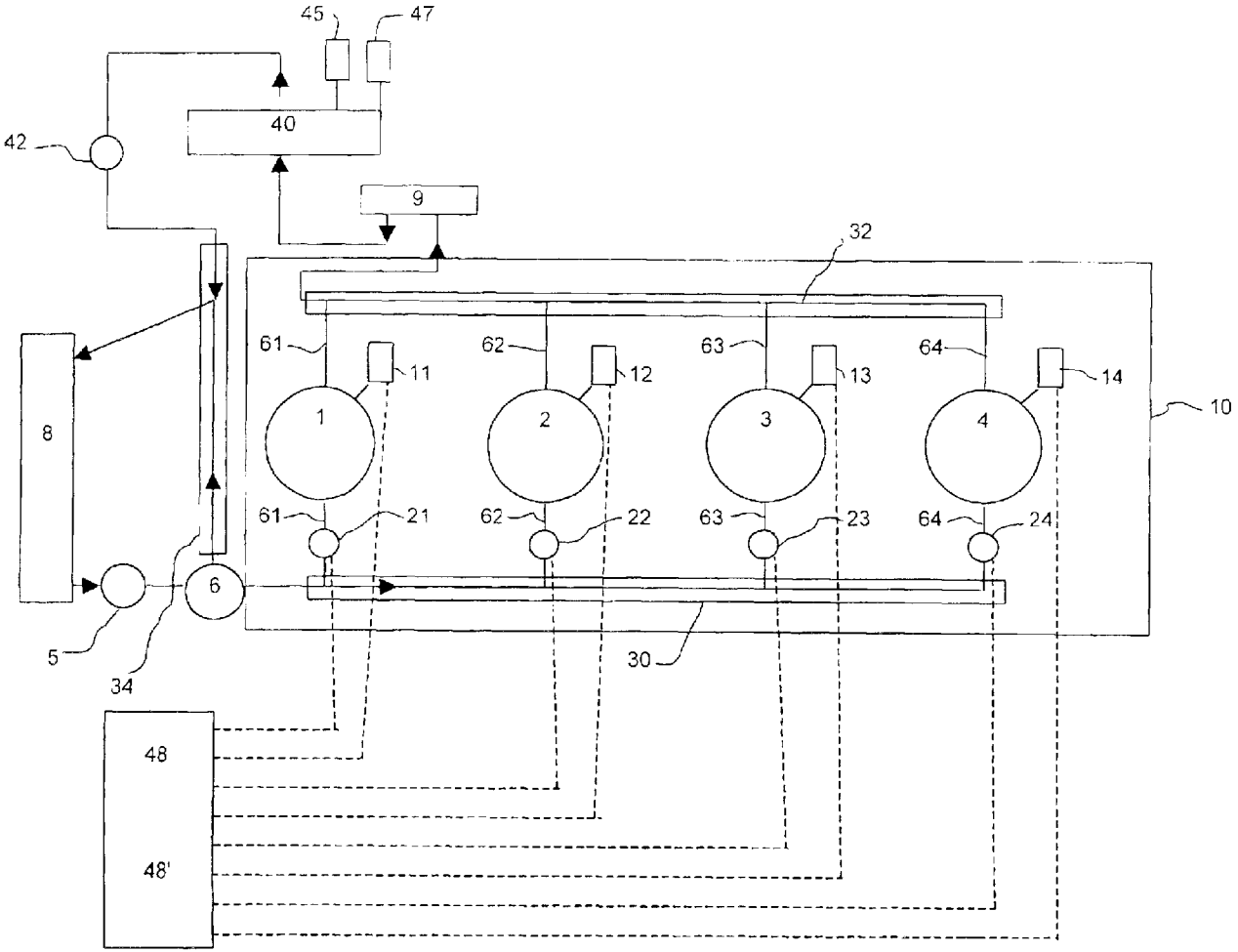
FIG. 1 is a schematic diagram of a first embodiment of the system of the present invention.

A schematic description of a first preferred embodiment, in the form of a coolant circuit for a 4-cylinder engine cylinder head 10, is shown in FIG. 1. The system shown in FIG. 1, of course, can be adapted to engines with any number of cylinders. Each of cylinders 1, 2, 3, and 4 has associated with it a flow control valve and a sensor. Thus, cylinder 1 has a flow control valve 21 and a temperature sensor 11, cylinder 2 has a flow control valve 22 and a temperature sensor 12, cylinder 3 has a flow control valve 23 and a temperature sensor 13, and cylinder 4 has a flow control valve 24 and a temperature sensor 14. The coolant system further includes a water pump 5, a splitter valve 6, a radiator 8, and a heat exchanger (heater) 9 for heating the passenger compartment. A check valve 42 prevents backflow through heater 9 during warmup. Coolant flow from the inlet rail 30 to the outlet rail 32 is through separate channels 61, 62, 63, and 64 formed within the interior of the cylinder head 10 and extending across the cylinder head from an inlet rail 30 to an outlet rail 32.

When the engine starts up from cold, the splitter valve, which may operate like a conventional thermostat, directs all the coolant flow output from pump 5 through the bypass rail 34. Flow control valves 21, 22, 23, and 24 are closed, and the coolant warms up rapidly in the cylinder head 10. When the temperatures indicated by temperature sensors 11, 12, 13, and 14 are at appropriate levels, flow control valves 21, 22, 23, and 24 are opened appropriate amounts to regulate the temperature of each cylinder consistent with the optimum predetermined value.

Although FIG. 1 shows the flow control valves 21, 22, 23, and 24 on the inlet side of the coolant flow path across the engine, alternatively they could be located on the outlet side of the coolant flow path. The temperature sensors 11, 12, 13, and 14 are positioned in appropriate locations within the cylinder head and may or may not be directly in the coolant flow path.

A controller 48, having a memory 48', serves to individually control each of flow control valves 21, 22, 23, and 24 in accordance with signals received from their respectively associated temperature sensors 11, 12, 13, and 14. The controller 48 receives a signal related to torque or a torque signal from a torque load sensor 45 and/or an engine speed signal from an engine speed sensor 47, applies the signal(s) to a lookup table stored in memory 48' to determine an optimum temperature for the sensed torque load and/or engine speed and individually controls each flow control valve to bring the temperature sensed by its associated temperature sensor to the optimum temperature. Alternatively, the controller 48 may be adapted to compute an optimum temperature based on the sensed engine speed and/or torque load.

Figure 2:
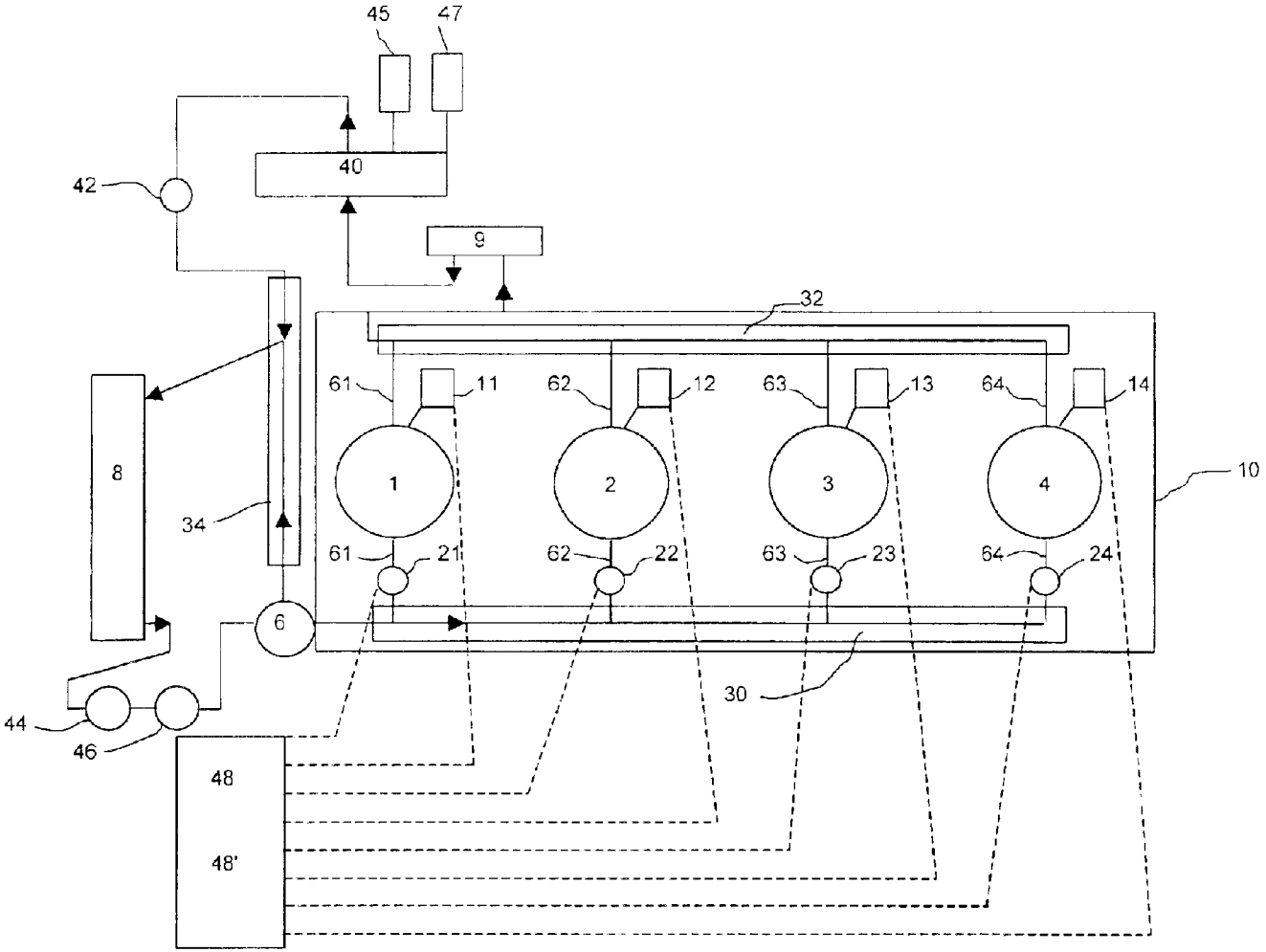
FIG. 2 is a schematic diagram of a second embodiment of the system of the present invention.

A second embodiment shown in FIG. 2 has two water pumps 44 and 46 rather than a single water pump as in the first embodiment. The other components of the second embodiment are the same as in the first embodiment. The purpose of the additional water pump is to provide a higher coolant flow rate to the cylinder head during times of great thermal stress to the cylinder head such as in high engine speed or high engine torque operation. Provision of this additional cooling allows for a substantial increase in engine power, especially for short bursts, and does not penalize the engine due to an increase in parasitic power required to drive a larger flow capacity pump when the extra coolant flow is not needed (most of the time). FIG. 2 shows a series configuration for the water pumps, but a parallel configuration is also possible.

Figure 3:
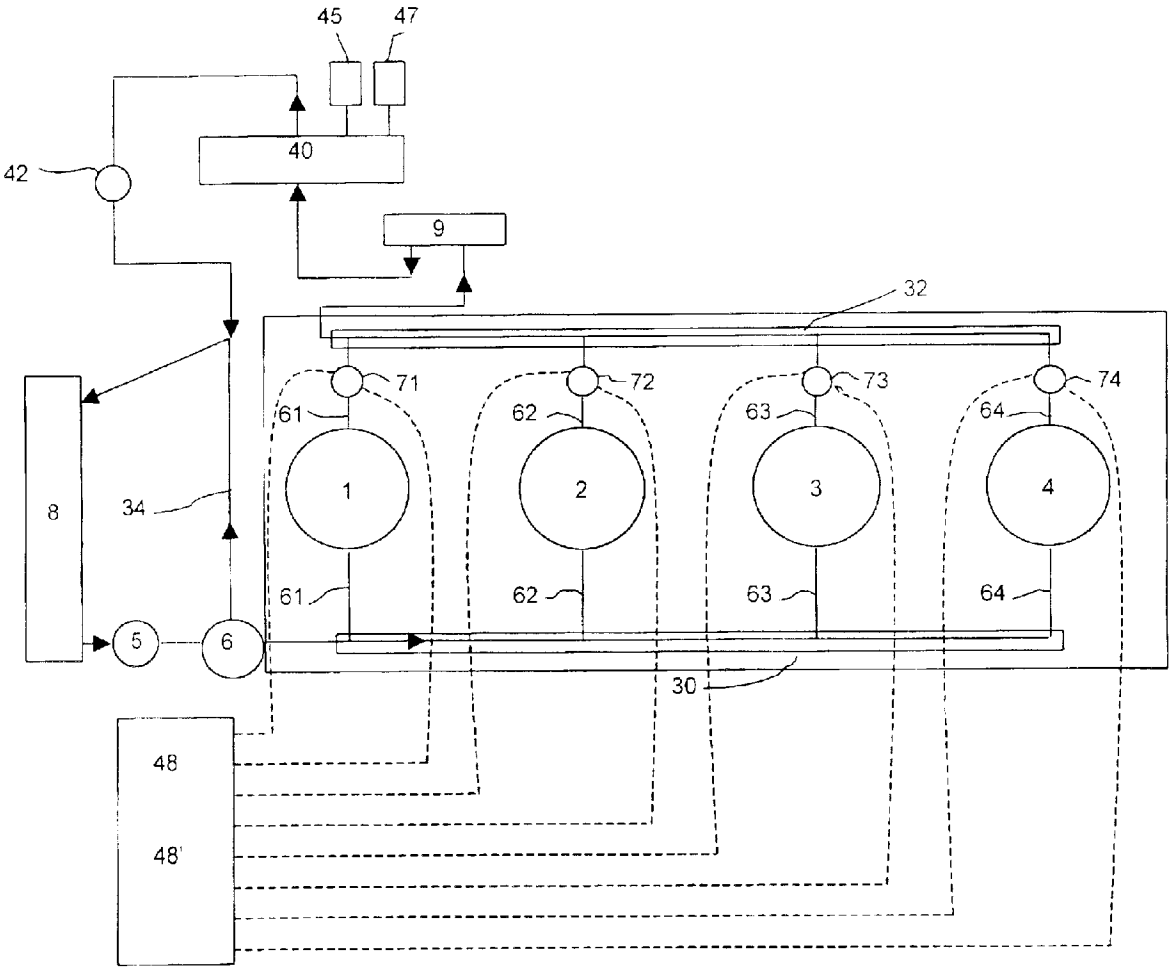
FIG. 3 is a schematic diagram of a third preferred embodiment of the present invention.

In a third embodiment shown in FIG. 3, the coolant flow control valve and the coolant temperature sensor are integrated in each of units 71, 72, 73, and 74 installed in the coolant flow on the outlet side of the cylinder head. This third embodiment provides packaging and cost advantages. The other components of the third embodiment are the same as those of the first embodiment.

Additional embodiments of the invention can be divided into two classes: (1) embodiments for which the cooling flow circuit differs from the above-described preferred embodiments and (2) embodiments for which the number of flow control valves per cylinder and the number of temperature sensors per cylinder differ from 1.0

A. Embodiments Having Different Cooling Flow Circuits

The cooling flow for the cylinder block 40 can be provided in several ways, all of which arc compatible with this invention.

The coolant system for the engine block can be entirely separate from that for the cylinder head, including a different radiator, a different control approach, or even a different coolant medium including, but not limited to, engine oil or transmission fluid. The coolant flow within the cylinder block in the entirely separate system can be conventional or it can be a variant of this individual cylinder coolant control system (ICCCS).

The coolant system for the engine block can be part of the same cooling system as the one for the cylinder head. In the "series configuration" shown in FIG. 1, the coolant flow, when the engine is warmed up, goes from the cylinder head 10 through heater 9, then to the cylinder block 40, and then back to the radiator 8, the water pump 5, and the splitter valve 6.

As described above, the coolant from within the cylinder block can be of a conventional nature or a variant of the individual cylinder coolant control system of the present invention.

Another possible coolant flow configuration is a parallel path in which the flow exits the splitter valve 6 apportioned into flows to the cylinder head 10, the bypass line, and the cylinder block. The flow within the cylinder block can be of a conventional nature or of the ICCCS type.

B. Embodiments for which the Number of Coolant Flow Control Valves Per Cylinder and/or the Number of Temperature Sensors Per Cylinder are other than 1.0

The number of coolant flow control valves and/or the number of temperature sensors per cylinder may be less than 1.0. As an example, consider the case for which there are two coolant flow control valves and temperature sensors for a four-cylinder engine. In this case, the ratio of coolant flow control valves and/or temperature sensors to the number of engine cylinders is 0.5. Various configurations with ratios of coolant flow control valves and/or temperature sensors to the number of cylinders ranging from 0.0625 to 0.9375 are possible.

The number of coolant flow control valves and/or temperature sensors per cylinder may also be greater than 1.0. As an example consider the case for which there are two coolant flow control valves and two temperature sensors for each cylinder of a four-cylinder engine. In this case, the ratio of coolant flow control valves and/or temperature sensors per cylinder is 2.0. The ratio of the number of the coolant flow control valves and/or the temperature sensors to the number of engine cylinders may range from 1.01 to 3.0.

In all embodiments the individual coolant flow passages 61, 62, 63, and 64, which traverse the cylinder head, can take any number of shapes. For example, each coolant flow passage could encircle (or nearly so) the exhaust valve seat(s) to provide extra cooling to that part of the combustion chamber. The flow paths can be separate as illustrated in the drawings or join each other as appropriate. They could also cross over/under each other.

The flow passages 61, 62, 63, and 64 could also encircle (or nearly so) the intake valve 71 seat(s), exhaust valve 72 seats, and/or provide targeted cooling to the ignition device 73, e.g., the spark plug or the glow plug of the engine. FIGS. 4*a*, 4*b*, 4*c*, 4*d*, and 4*e* show the geometries of some of the geometrical pathways that the coolant flow could take across the cylinder head. In each case, the coolant flow is depicted entering the targeted cooling area at the bottom of the figure (COOLANT IN) and exiting the targeted cooling area at the top of the figure (COOLANT OUT). Of course, this coolant flow could also be reversed.

The flow paths shown are illustrative of the options available with the individual cylinder coolant control system of the present invention. The concept can apply to geometries other than those shown, to cylinder heads with more than two valves (i.e., 3 valves, 4 valves, 5 valves, etc.), and to cylinder heads where the spark plug shown is replaced by a glow plug or some other ignition device, such as those used in a Diesel engine.

Thus, the present invention offers the advantage that the cooling can be targeted toward areas that require more cooling, such as the exhaust valve area. In addition, the individual cylinder controls allow for improved overall control due to cylinder-to-cylinder variabilities in the cylinder head manufacturing process which would result in non-uniform cooling using the prior art.

Operation

When the engine is started, the flow of coolant goes through the splitter valve 6 and the bypass rail 34 and back to the radiator 8 and pump 5, thus bypassing the cylinder head 10, the cylinder block 40 and the passenger compartment heater 9. The cylinder head 10 warms up quickly since no coolant flow is removing heat transferred through the cylinder walls. When the cylinder head temperature sensors 11, 12, 13, and 14 indicate that coolant temperature is appropriate, the splitter valve 6 opens, permitting flow of coolant into the inlet common rail 30, and across the cylinder head 10 to the outlet common rail 32. The outputs from the cylinder head temperature sensors go to the controller 48 which adjusts the individual cylinder control valves 21, 22, 23, and 24 to adjust coolant flow to each cylinder so that the same appropriate temperature is obtained for the coolant exiting each coolant flow passage.

Two examples of possible control approaches are: (1) equal temperature and (2) performance based. As an example of the equal temperature control approach, the best cylinder temperature for a given engine load and speed, as detected by torque detection means 45 and speed sensor 47, respectively, is predetermined and is stored as a look-up table in memory 48'. The controller 48 adjusts the coolant flow valves for each cylinder to produce the same (optimum) temperature for each cylinder, thus guaranteeing optimum performance.

In the performance-based system, the control of the temperature is used to optimize a dynamically determined performance measure. For example, in a system with individual cylinder pressure sensors, it would be possible to determine the location of peak pressure for each cylinder. For a given engine and combustion system, the location of peak pressure at which optimum efficiency occurs can be pre-determined. Usually, the best value for this performance measure is in the range of 10° to 15° of crankshaft motion after top dead center on the powerproducing stroke of the cylinder. In such a system the controller would control the coolant flow across the cylinder head in each cylinder so that the location of peak pressure in each cylinder is at the optimum value, even if the cylinder temperatures in the different cylinders are not the same.

Applications in General

The individual cylinder coolant control system (ICCCS) of the present invention improves the performance of all three engine types: spark ignition, Diesel, and HCCI, by enhancing faster cylinder head warmup. This improves the fuel consumption performance of the engine and reduces exhaust emissions which arc a result of excess fuel metered to the cylinder in starting and warming up the engine.

When the engine is started up, the coolant flow bypasses the cylinder head. With no cooling flow, the cylinder head warms up more quickly than it would if cold coolant were circulating through it. No controls are needed for the water pump.

The individual cylinder coolant control system of the present invention permits individual temperature control of each cylinder in the engine, since coolant flow can be adjusted to each cylinder to have all cylinders operating at the same conditions, thereby improving cylinder-to-cylinder combustion and power and allowing for smoother engine operation.

The efficiency of a spark-ignition engine is strongly a function of spark timing, the time relative to the piston's motion on the compression stroke when the ignition system causes a spark to jump the gap in the spark plug. However, the best efficiency spark timing cannot be reached for some conditions because of spark knock. Parts of the unburned mixture become too hot during the compression of the unburned mixture by the burned mixture. However, in accordance with the present invention, the temperature of the combustion chamber in each cylinder can be controlled and lowered near these knock-prone points to provide a spark timing resulting in better efficiency. In contrast, current engines do not achieve the best spark timing in each cylinder due to cylinder-to-cylinder cooling differences.

Application to Diesel Engines

High efficiency diesel engines have drawbacks when it comes to heating the passenger compartment, since heat rejected to the coolant is used for heating the passenger compartment.

During the warm up process, cold coolant circulates but bypasses the heat exchanger used to provide heat for the passenger compartment. The amount of coolant in the cylinder head is small, compared to the total coolant volume, so it warms up quickly. Adjusting the coolant flow across the cylinder head provides optimum temperatures to the coolant side of the passenger compartment heat exchanger for fast warmup of the passenger compartment since the heat exchanger is positioned to receive the coolant just after it is heated up by cooling the cylinder head.

Application HCCI Engines

Control of the temperature of the intake charge prior to the autoignition which is characteristic of HCCI combustion is the most important control parameter for this combustion type.

The ICCCS of the present invention can vary the combustion chamber temperature in each cylinder so that all of the cylinders are undergoing HCCI combustion, and, in addition, undergoing HCCI combustion at the same time so that the heat release for each cylinder is timed for optimum engine efficiency. This can be done in an open loop manner, or the ICCCS system can be adapted to control in a feedback loop using, for example, a sensor in each cylinder that gives a response that can be used to determine the location of peak pressure in that cylinder. Control valves can be adjusted to ensure that the peak pressure location is optimum for each cylinder.

The ICCCS is highly advantageous for HCCI combustion since the coolant flow to each cylinder can be changed rapidly.

The invention may be embodied in other specific forms without departing from the spirit or essential characteristics thereof. The present embodiments are therefore to be considered in all respects as illustrative, and not restrictive, the scope of the invention being indicated by the appended claims rather than by the foregoing description, and all changes which come within the meaning and range of equivalency of the claims are therefore intended to be embraced therein.

I claim:

1. A coolant system for an engine including a cylinder block having multiple cylinders formed therein, and a cylinder head, said coolant system comprising:

an inlet rail and an outlet rail located on opposing sides of the cylinder head;

a pump for feeding a coolant flow through a discharge line into the inlet rail;

a return line for returning the coolant from the outlet rail to the pump;

a plurality of individual coolant flow passages extending within the cylinder head and connecting the inlet rail with the outlet rail;

a control valve and an associated temperature sensor within each of said coolant flow passages;

a controller for individually controlling each of said control valves in accordance with a signal received from its associated temperature sensor.

2. The coolant system of claim 1 wherein each of said plurality of coolant flow passages is uniquely associated with a single one of said cylinders and wherein said controller, individually for each cylinder, controls a control valve to bring the temperature detected by the associated temperature sensor into conformance with a predetermined optimum temperature.

3. The coolant system of claim 2 wherein the optimum temperature is predetermined for engine load and/or engine speed.

4. The coolant system of claim 1 wherein the cylinder head has, mounted therein, at least paired intake and exhaust valves associated with each of the multiple cylinders and wherein a coolant flow passage is split and passes on both of opposing sides of said exhaust valve and one branch of the split coolant flow passage passes between the paired intake valve and exhaust valve, in passage across the cylinder head from the inlet rail to the outlet rail.

5. The coolant system of claim 4 wherein said coolant passage split to pass an exhaust valve on both opposing sides is further split to pass on opposing sides of the intake valve paired with the exhaust valve.

6. The coolant system of claim 1 wherein the cylinder head has, mounted therein, at least paired intake and exhaust valves and an ignition device associated with each of said multiple cylinders and wherein a coolant flow passage is split and passes on both of opposing sides of the ignition device.

7. The coolant system of claim 6 wherein said split coolant flow passage is further split to pass on one or both sides of the paired exhaust valve.

8. The coolant system of claim 7 wherein said split coolant flow passage is further split so as to pass on both of opposing sides of the paired intake valve.

9. The coolant system of claim 1 further comprising a bypass rail for connecting the discharge line to the return line, bypassing said inlet and outlet rails and said coolant flow passages, and a splitter valve for selectively directing the discharge of coolant from said pump to said inlet rail and/or to said bypass rail.

10. The coolant system of claim 1 wherein said inlet rail and said outlet rail are formed within said cylinder head.

11. The coolant system of claim 1 wherein said fluid flow passages are separate so that there is no fluid communication therebetween other than through said inlet and outlet rails.

12. The coolant system of claim 1 further comprising a passenger compartment heater in said return line and wherein coolant exiting the outlet rail flows, in succession, through the passenger compartment heater and through a coolant jacket of the cylinder block.

13. A method for controlling cylinder temperature in a multiple cylinder internal combustion engine including feeding coolant through a discharge line to a plurality of individual coolant flow passages extending within a cylinder head of the internal combustion engine, wherein the individual coolant flow passages traverse the cylinder head between an inlet rail receiving the coolant from a pump and an outlet rail, and individually controlling coolant flow through each of the flow passages in accordance with a signal received from a temperature sensor which senses the coolant temperature within that coolant flow passage.

14. The method of claim 13 further comprising detecting torque load on the internal combustion engine, determining an optimum temperature for the detected torque load and controlling coolant flow through each of the plural coolant flow passages to bring the temperature detected for each coolant flow into conformance with the optimum temperature.

15. The method of claim 14 wherein the detected torque load is applied to a table contained in memory to determine the optimum temperature.

16. The method of claim 14 additionally comprising detecting engine speed and controlling coolant flow through each of the coolant flow passages in accordance with the detected engine speed, detected torque load and signal received from a temperature sensor associated with a coolant flow passage.

17. The method of claim 13 further comprising detecting engine speed, determining an optimum temperature for the detected engine speed and controlling coolant flow through each of the coolant flow passages to bring the temperature detected for that coolant flow passage into conformance with the optimum temperature.

18. The method of claim 17 wherein the detected engine speed is applied to a table stored in memory to determine an optimum temperature and the coolant flow through each of the plural coolant flow passages is controlled to bring the temperature detected for that coolant flow passage into conformance with the determined optimum temperature.

19. The method of claim 13 additionally comprising bypassing the coolant flow passages, during warm-up of the internal combustion engine, until at least one detected temperature reaches a predetermined minimum value.

20. The method of claim 13 additionally comprising splitting each of the coolant flows through the plurality of coolant flow passages so that each individual coolant flow passes on both of opposing sides of an exhaust valve, an inlet valve and/or an ignition device of a cylinder.

* * * * *